US006981597B2

(12) United States Patent
Cash

(10) Patent No.: US 6,981,597 B2
(45) Date of Patent: Jan. 3, 2006

(54) STORAGE UNIT AND SYSTEM

(76) Inventor: James M. Cash, 500 Kedzie St., East Lansing, MI (US) 48823

( * ) Notice: Subject to any disclaimer, the term of this patent is extended or adjusted under 35 U.S.C. 154(b) by 40 days.

(21) Appl. No.: 10/443,435

(22) Filed: May 22, 2003

(65) Prior Publication Data

US 2004/0232092 A1 Nov. 25, 2004

(51) Int. Cl.
*A47B 73/00* (2006.01)

(52) U.S. Cl. ..... 211/74

(58) Field of Classification Search ..... 211/74, 211/131, 151, 71.01, 126.15
See application file for complete search history.

(56) References Cited

U.S. PATENT DOCUMENTS

| | | | | |
|---|---|---|---|---|
| 3,033,636 A | * | 5/1962 | Wurtz et al. | 312/298 |
| 4,022,327 A | | 5/1977 | Anderson | |
| 4,220,245 A | | 9/1980 | Corcoran | |
| 4,391,378 A | | 7/1983 | Secon | |
| 4,496,037 A | * | 1/1985 | Spamer | 193/2 R |
| 4,546,887 A | | 10/1985 | Cohn | |
| 4,576,423 A | * | 3/1986 | Hendriks | 312/216 |
| 4,577,765 A | | 3/1986 | Crosby | |
| 4,811,999 A | * | 3/1989 | Remington et al. | 312/249.8 |
| 4,936,641 A | | 6/1990 | Bussan et al. | |
| 4,998,631 A | | 3/1991 | Fridjhon | |
| 5,169,009 A | | 12/1992 | Bomze | |
| 5,215,199 A | | 6/1993 | Bejarano | |
| 5,244,272 A | * | 9/1993 | Thompson | 312/334.23 |
| 5,520,291 A | * | 5/1996 | Graham | 211/4 |
| 5,848,534 A | | 12/1998 | Stauffer | |
| 6,361,192 B1 | | 3/2002 | Borgen | |
| 6,454,108 B1 | * | 9/2002 | Gerard | 211/74 |
| 2002/0134744 A1 | | 9/2002 | Kessell et al. | |

OTHER PUBLICATIONS www.wineenthusiast.com/templates/winestorage.asp?uid=48C35225–694A–483B–BB68–E8060D578839.
EuroCave advertisement from Wine Enthusiast, Mar. 2003, p 59.
M Stromberg, Wine Rooms: For storage and showing off, Professional Builder, Apr. 2003, pp 119 & 121.
S. L. Miller, Rare Vintage, Custom Home, Apr. 2003, pp 82 & 84.
International Wine Accessories, Inc. catalog,Early Spring 2003, 10246 Miller Rd., Dallas, TX 75238.
International Wine Accessories, Inc. catalog, Holiday Gift 2001, 10246 Miller Rd., Dallas, TX 75238.
Brochure of Specialty Components contained Wine Cellars and More catalog.

* cited by examiner

*Primary Examiner*—Sarah Purol
(74) *Attorney, Agent, or Firm*—Dickinson Wright PLLC; John M. Naber

(57) ABSTRACT

A storage unit configured to store and display items such as wine bottles includes a frame member including a top, a base and a plurality of vertically extending walls. A plurality of shelves are slidably attached to the frame member and configured to store a plurality of items. At least one insert may be positioned within the plurality of shelves to provide a support for the items contained therein. A strap, having a first end and a second end and extending substantially transverse to the front edge of the plurality of shelves is also provided and prevents the plurality of shelves from sliding. The shelves may be removed from the frame member and stored on a top surface of the frame member to reconfigure the storage space within the storage unit.

18 Claims, 8 Drawing Sheets

STORAGE UNIT AND SYSTEM

BACKGROUND OF THE INVENTION

1. Field of the Invention

The present invention generally relates to a storage unit and particularly to a storage unit and system to store and display multiple items such as wine bottles.

2. Discussion of the Prior Art

Storage units known in the art are used to store and display a variety of different objects. Some units include racks to display stored items. Others include cabinets or drawers to conceal and store items. Many storage units also include a locking ability.

For storing particular items such as wine bottles, there is also a variety of types and styles of storage units available to meet a user's particular needs. Several simple wine cellar rack designs inefficiently allow for both storage and display of wine collections. In contrast, other designs can be very expensive and include features such as refrigeration or thermal controls, or other complicated components and structures. Both simple and complex units are inflexible and frequently designed specifically for a particular type of bottle or object.

Thus, there is a desire and need in the art to provide a simple, flexible and cost effective unit for storing and displaying items such as wine bottles. Such unit should provide storage of multiple items in a variety of display orientations with efficient utilization of space.

SUMMARY OF THE INVENTION

Accordingly, the present invention provides a storage unit configured to store and display items such as wine bottles in a variety of configurations and efficiently utilize the capacity of the storage unit.

In one embodiment of the present invention, a storage unit configured to store and display items includes a frame member having a plurality of vertically extending walls and a plurality of shelves slidably attached to the frame member. The plurality of shelves is configured to store a plurality of items. An insert may be positioned within at least one of the plurality of shelves and supports and substantially minimizes movement of the stored items.

In another embodiment of the present invention, a storage unit includes a frame member having a top, a base and a plurality of vertically extending walls. A plurality of shelves is slidably attached to the frame member having a front edge and a plurality of retainer brackets extending substantially upwardly from said front edge. The plurality of shelves is configured to store a plurality of items.

In yet another embodiment of the present invention, a storage unit includes a frame member and a plurality of shelves slidably and removably coupled to the frame member. The plurality of shelves and frame member define a first plurality of spaces to store a plurality of items in a first configuration. The plurality of shelves is reconfigurable to provide a second plurality of spaces to store a plurality of items in a second configuration.

Other features of the present invention will become more apparent to persons having ordinary skill in the art to which the present invention pertains from the following description and claims taken in conjunction with the accompanying figures.

BRIEF DESCRIPTION OF THE FIGURES

The foregoing features, as well as other features, will become apparent with reference to the description and figures below, in which like numerals represent like elements, and in which.

DETAILED DESCRIPTION OF THE INVENTION

The present invention generally relates to a storage unit and system configured to store and display items such as wine bottles. The storage unit of the present invention is capable of storing different sizes of bottles and provides greater storage capacity than traditional wine racks. The present invention also provides an improved system of storing wine bottles by providing a reconfigurable storage unit that may be modified to meet the needs of a particular user. Such modifications may include reconfiguring the shelves to provide for less or more vertical space as needed for storing different sized bottles or other objects. Other modifications may include modifying an insert placed within the shelves for purposes such as to accommodate different sized bottles, and to support and substantially minimize movement of the bottles while in storage.

Figure 1:
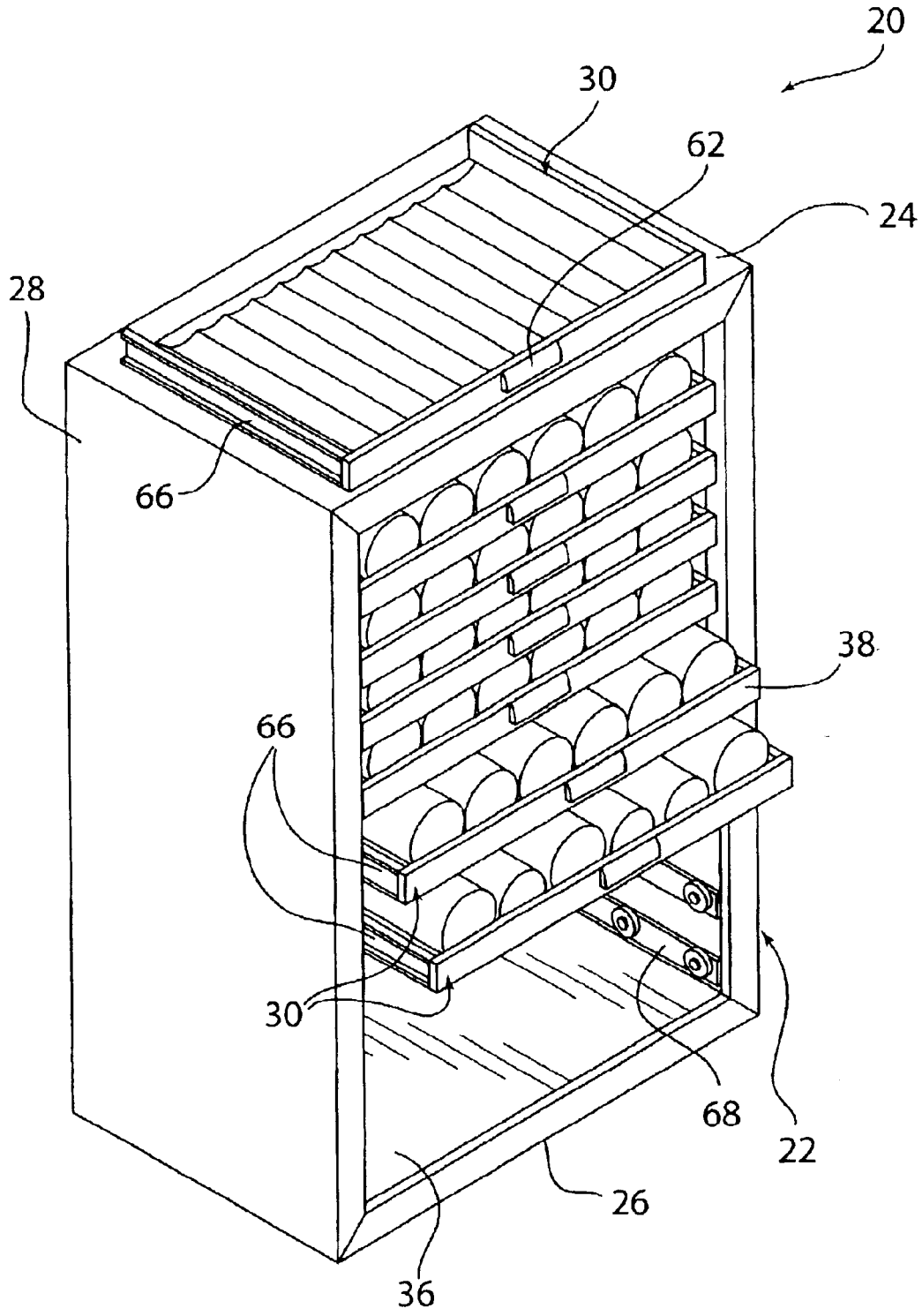
FIG. 1 is a perspective view of a storage unit of the present invention.

As shown in FIG. 1, a storage unit 20 includes a frame member 22 having a top 24, a base 26 and a plurality of vertically extending walls 28. A plurality of shelves 30 may be slidingly connected to walls 28 using mechanics well known in the art. Shelves 30 may include a bottom surface 37 (shown in FIGS. 2A–2C) and are configured to store or display items such as wine bottles as shown in FIG. 1. Shelves 30 may alternatively include an interior peripheral ledge 39 instead of bottom surface 37 as shown in FIGS. 3A and 3B. For purposes of illustration, wine bottles are shown and referred to in the figures and specification. It is to be understood that other items could alternatively be stored within storage unit 20. Wine bottles are used to illustrate the benefits of the present invention since they exist in a variety of bottle shapes and sizes. Also, there are various levels of value associated with the variety of wine products available to consumers and collectors. Some wine products are very rare and expensive and require a higher level of protection during storage, while others require only a simple storage system. The present invention provides a versatile storage unit and system capable of achieving the various degrees of protection that may be required by the particular user.

Shelves 30 may be releasably and slidably connected to frame member 22 as shown in FIG. 1, using a standard smooth action slide assembly readily available in the art. Many different types of slide mechanisms are available that may be easily incorporated into the storage unit 20 such as a ball bearing type currently manufactured and sold by SCHOCK METAL AMERICA, INC. of Chesapeake, Va. A high quality, smooth action slide assembly is desired to reduce vibration of the contents of shelves 30 when they are being opened and closed. This is particularly important when rare and expensive wine vintage items are being stored. A slide assembly of the present invention may be designed to permit shelves 30 to be removed from frame member 22 and may include a pair of first slide brackets 66 attached to shelves 30 as shown in FIGS. 3A, 3B, 4A, and 5A, and a pair of mating second slide brackets 68 mounted on an inside surface of opposing vertical walls 28 as shown in FIG. 1. In use, shelves 30 are able to slide to an open position substantially outside of frame member 22, where there is greater accessibility and easy retrieval of the items stored within storage unit 20. Shelves 30 may also be removable from frame member 22 by opening shelves 30 to a fully opened position and lifting shelves 30 out of second slide brackets 68. A slide assembly allows more capacity for storage since space is not needed for each shelf to allow removal of items.

Figure 11A:
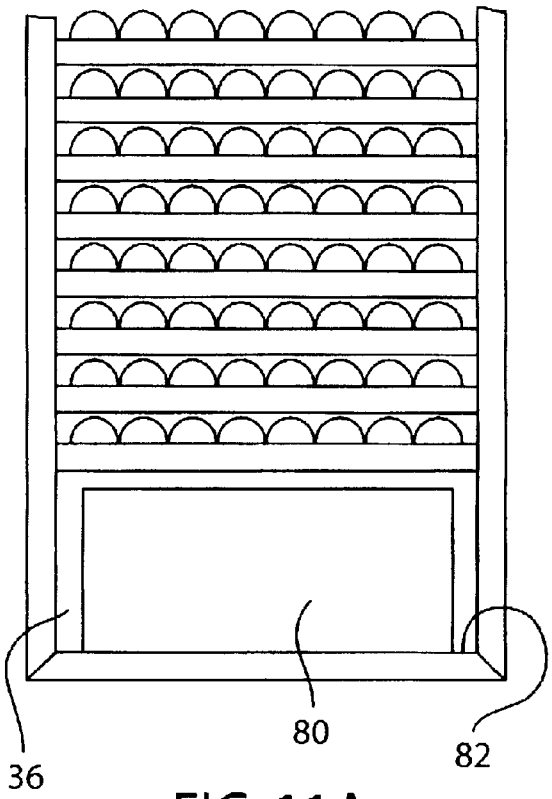
FIGS. 11A and 11B are front views of a portion of a storage unit of the present invention illustrating objects stored and displayed in a bottom space of the storage unit.
Figure 11B:
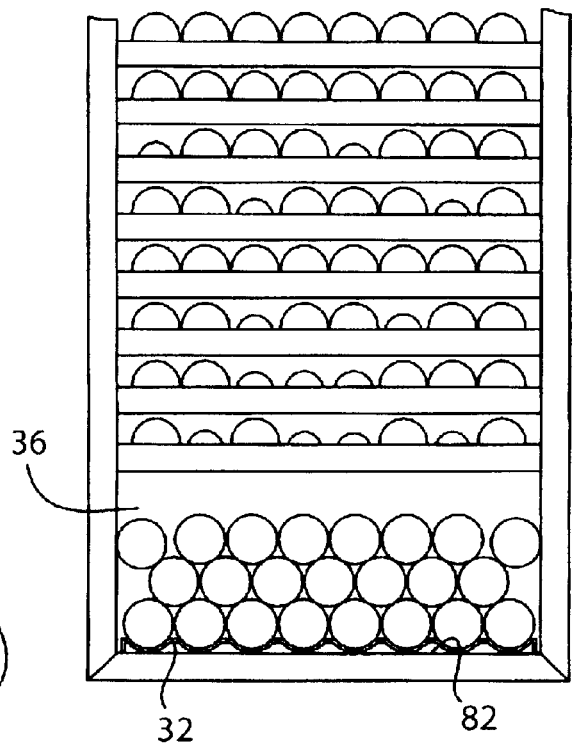

Removable shelves 30 from frame member 22 further add to the flexibility of storage unit 20. The resultant space 36 from the removed shelf allows for storage of different sized items, such as a case of wine bottles shown at 80 in FIG. 11A. Based on the desired size of space 36, any number of shelves 30 may be removed to reconfigure storage unit 20, and several spaces 36 may be configured if so desired. In FIGS. 1, 11A and 11B, storage space 36 is shown at a bottom location, but storage space 36 may alternatively be configured at different areas within storage unit 20. The shelves 30 that are removed from frame member 22 may be stored on top 24 and can be reinserted into frame member 22 at a later time as the storage needs of the user change. Stacking or latching mechanisms may also be added to secure the removed shelves 30 using means known in the art. Such latching mechanisms may alternatively allow for mounting the shelves 30 to an outer surface of the plurality of vertically extending walls 28. For instance, hanging them on a peg mounted on the plurality of vertically extending walls 28. Thus, storage unit 20 is reconfigurable to accommodate a particular user's storage and space requirements.

Figure 2A:
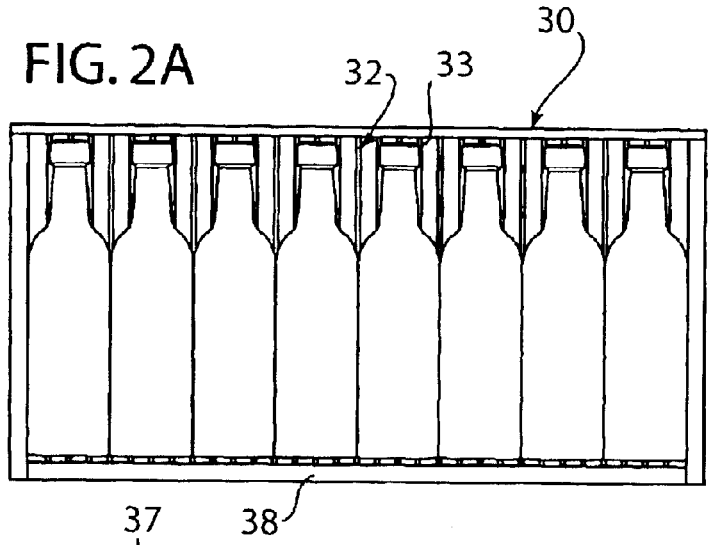
FIGS. 2A, 2B and 2C are top views of a shelf of the present invention.
Figure 2B:
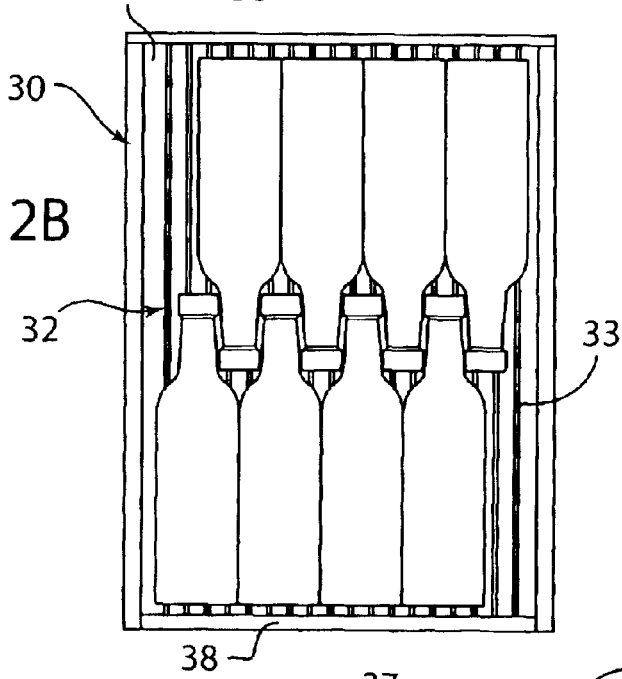
Figure 2C:
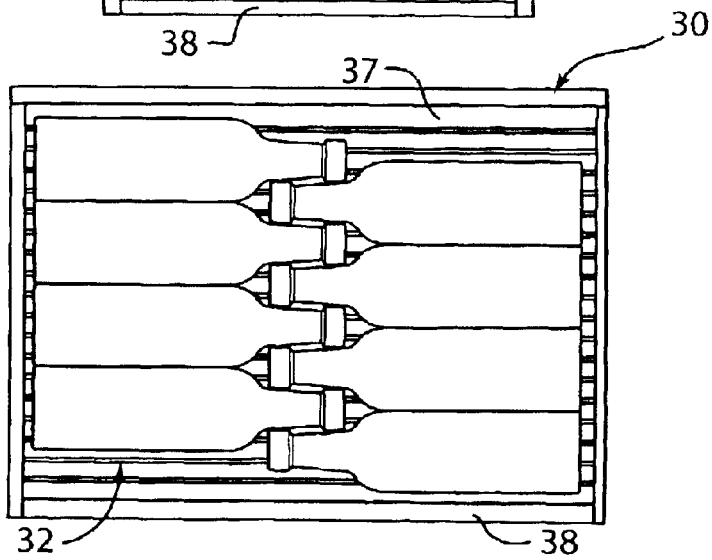
Figure 3A:
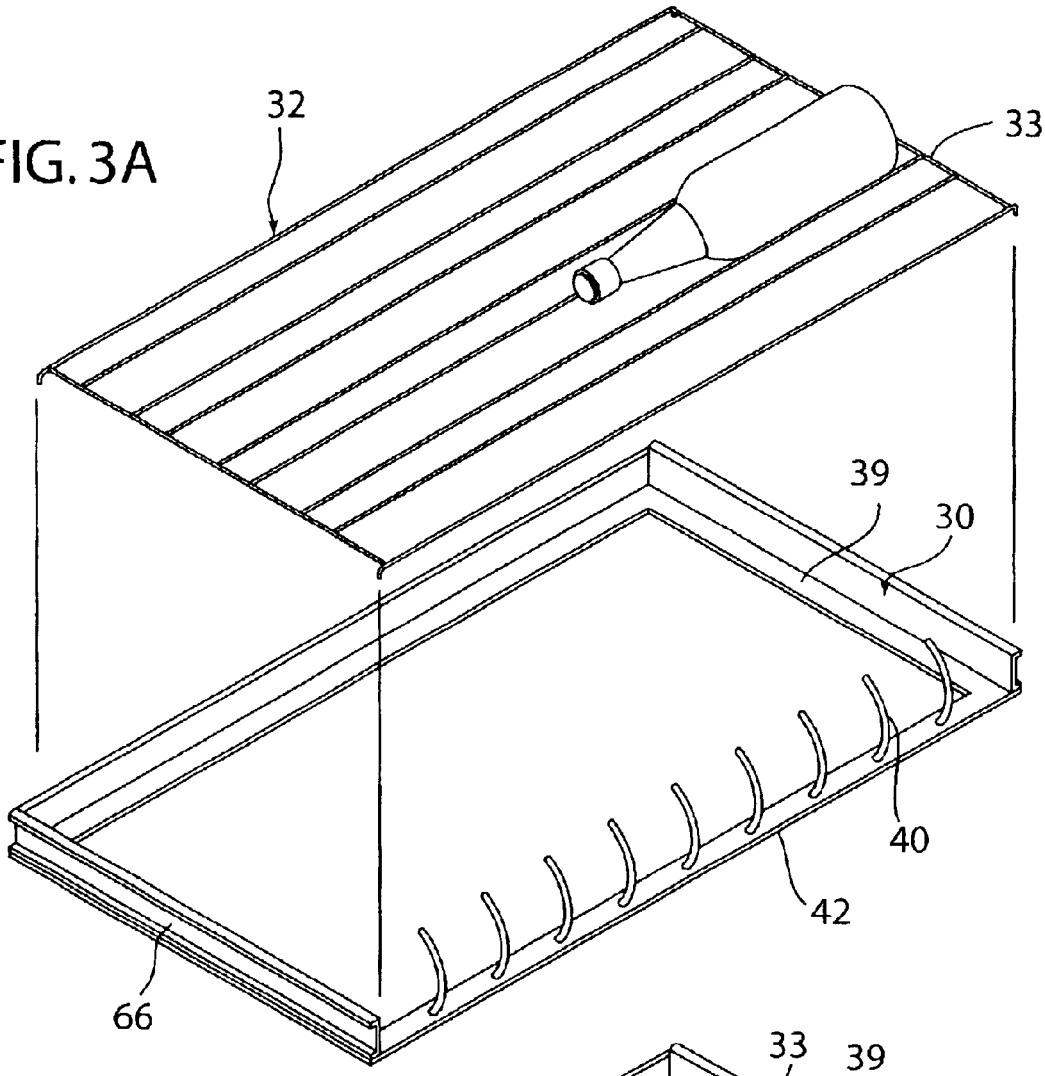
FIG. 3A is an exploded perspective view of a shelf of the present invention.
Figure 3B:
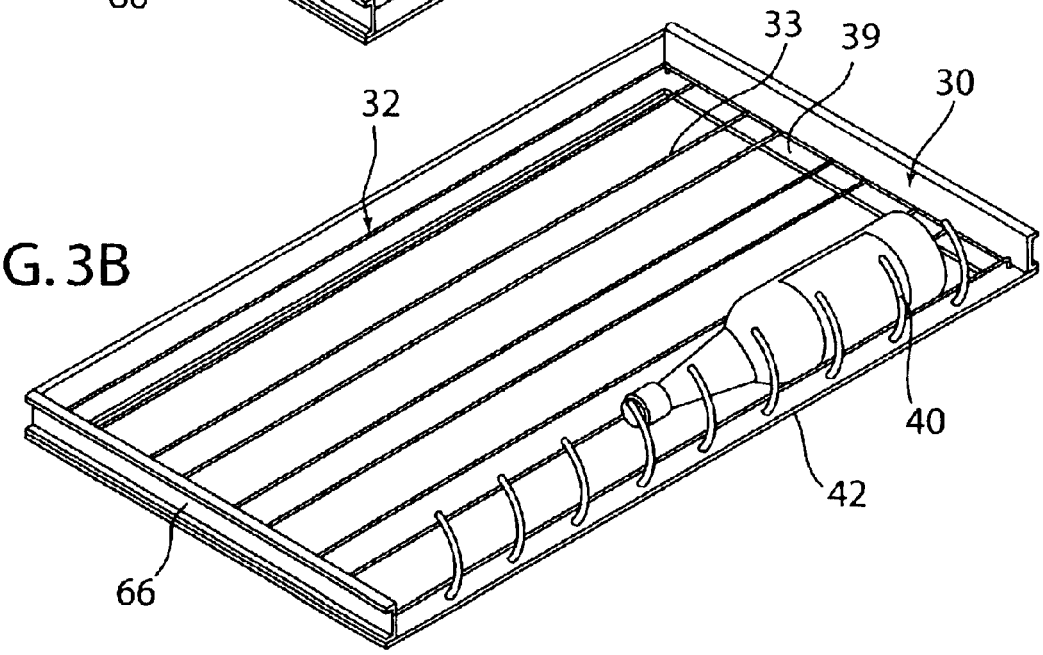
FIG. 3B is an assembled perspective view of the shelf shown in FIG. 3A.
Figure 10A:
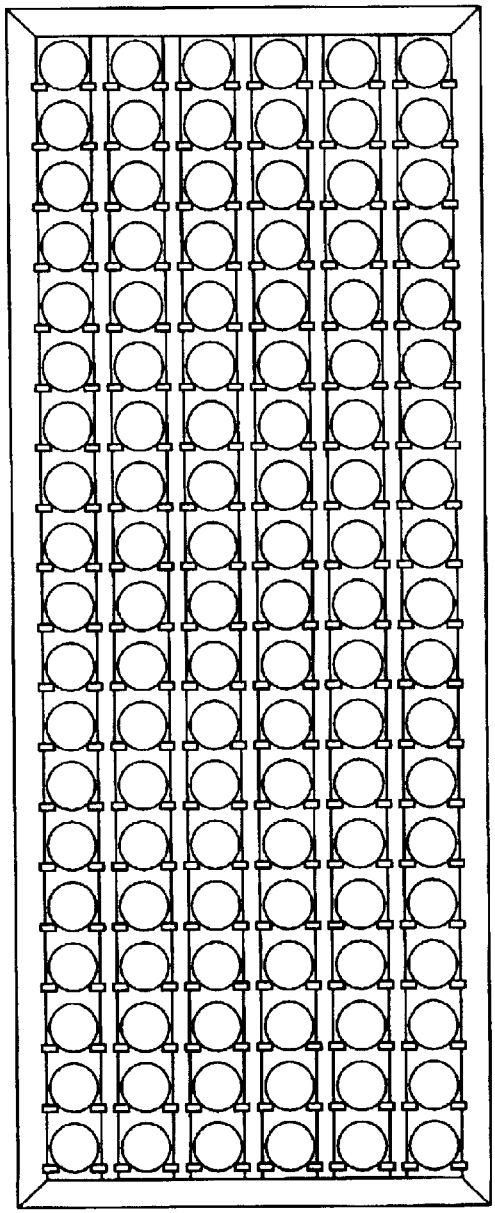
FIG. 10A PRIOR ART
FIGS. 10A and 10B illustrate a comparison of storage capacity between the present invention and a prior art wine rack.
Figure 10B:
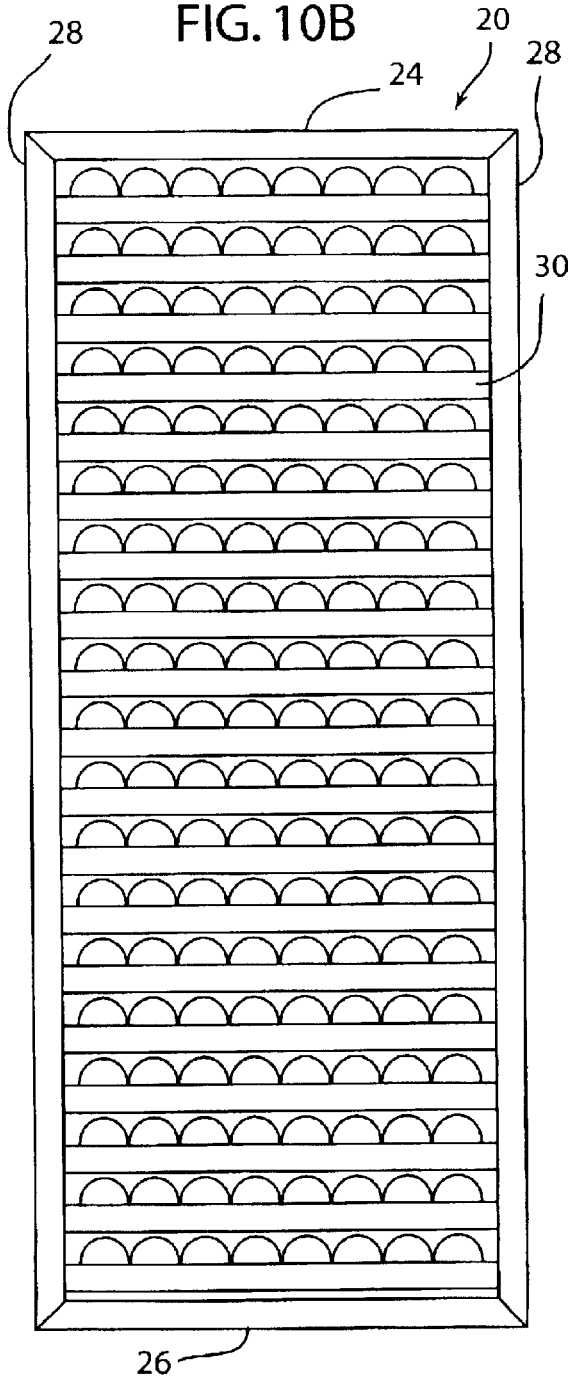

Shelves 30 of the present invention allow for greater storage capacity than traditional display and storage racks for items such as wine bottles, because the bottles can be oriented in several different configurations as shown in FIGS. 2A–2C. This variety of possible orientations of the bottles helps maximize use of storage unit 20. The capacity of traditional storage units having slots or racks configured for individual items is limited by the particular number of slots designed into the rack, and by the particular size of the slots. FIGS. 10A and 10B illustrate the capacity of a typical prior art wine rack compared to the capacity of a storage unit of the present invention. In this example, the storage unit 20 of the present invention provides for approximately twenty-seven percent more capacity than a prior art unit having the same overall dimensions. Because the space within shelves 30 of storage unit 20 is not limited to any specific design configuration, a variety of sizes (see FIGS. 1 and 11) and orientations of the bottles may be achieved. In contrast, in some prior art wine racks such as the wine rack shown in FIG. 10A, the size of the bottle is limited to one specific space size.

In the present invention, bottles may be arranged lengthwise as shown in FIGS. 2A and 2B (i.e., perpendicular to a front edge of the storage unit 20) or laterally as shown in FIG. 2C (i.e., parallel to the front edge of the storage unit 20). Bottles may also be oriented in a staggered configuration into two or more rows, depending on the size of the shelves as shown in FIGS. 2B and 2C. In other prior art wine racks, bottles may be stored inefficiently because the space occupied by the neck of the bottles is wasted. As shown in FIGS. 2B and 2C, the unused space typically occupied by the area surrounding the neck of the bottles is minimized by staggering the bottles within shelves 30. Combining this efficient use of the shelves 30, with the slidability of the shelves 30, allows for increased storage capacity within storage unit 20. Storage unit 20 may also include labels 62 as shown in FIG. 1. Labels 62 may be attached to frame member 22 or to the individual shelves 30, or both, to identify the contents of the storage unit 20 or shelves 30.

Shelves 30 may also include an insert 32 that may be positioned on either bottom surface 37 or ledge 39, as shown in FIGS. 3A through 5B. Insert 32 may also be positioned on a floor surface 82 as shown in FIG. 11B to aid in stacking wine bottles or other objects within space 36. The storage unit 20 may come to the consumer as a kit having several types of inserts or the insert may be purchased separately to allow for maximum flexibility. Such inserts may include the examples as shown, foam inserts or any other type of removal insert known to those in the art.

Figure 4A:
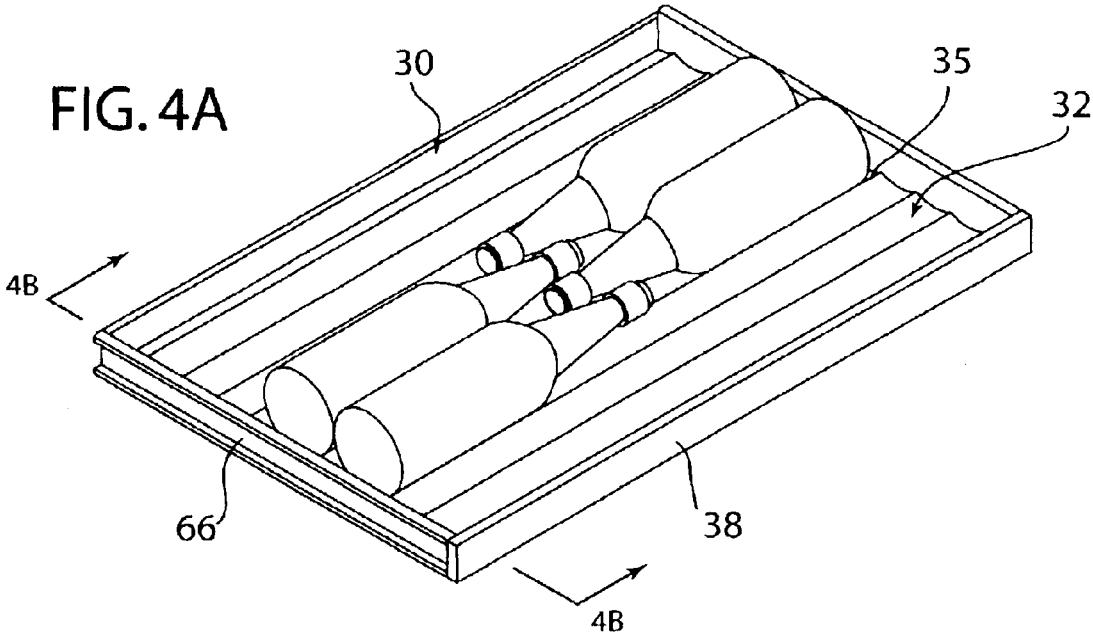
FIG. 4A is a perspective view of a shelf of the present invention.
Figure 4B:
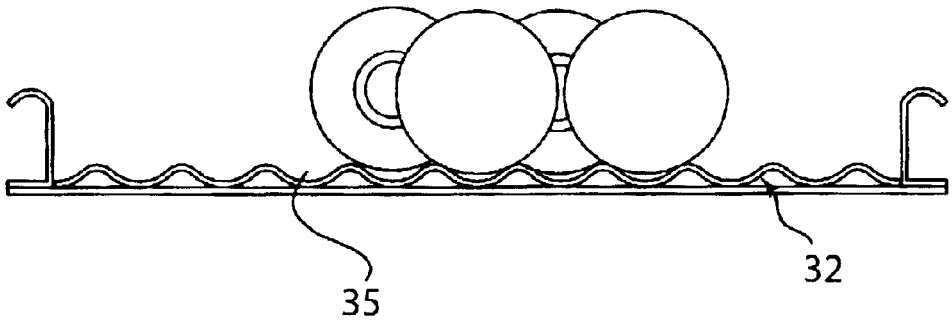
FIG. 4B is a sectional view taken along line 4B—4B in FIG. 4A.
Figure 5A:
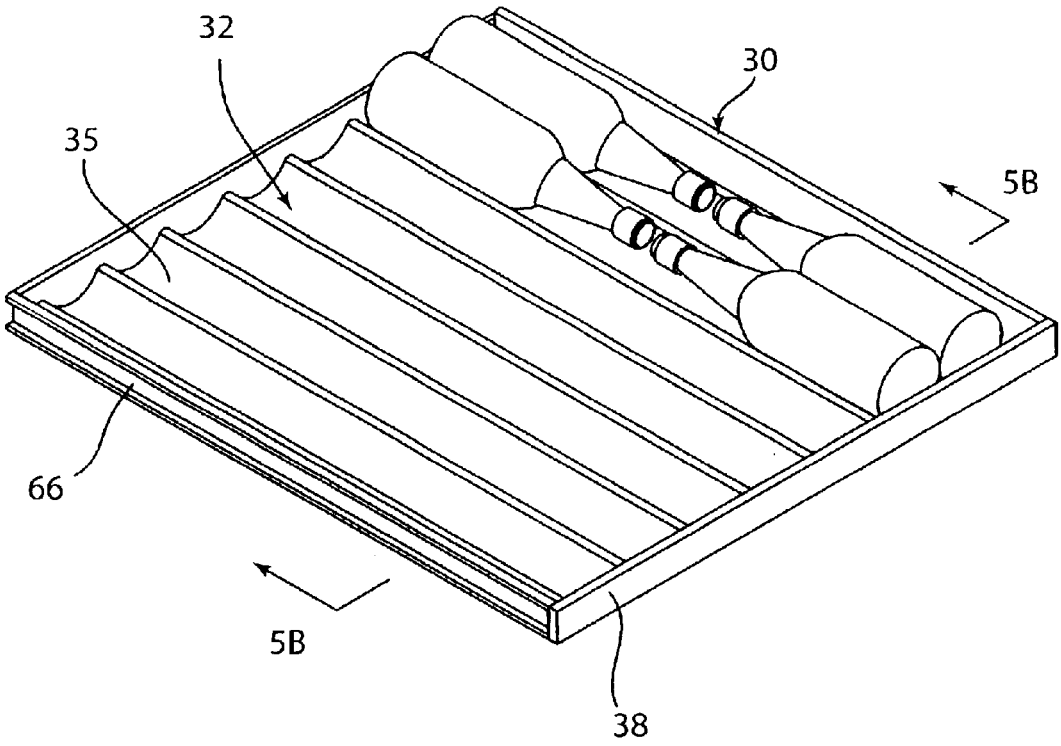
FIG. 5A is a perspective view of a shelf of the present invention.
Figure 5B:
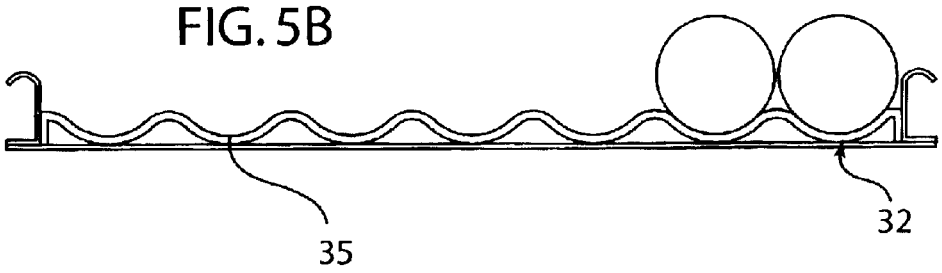
FIG. 5B is a sectional view taken along line 5B—5B in FIG. 5A.

In one embodiment, insert 32 may be configured having a plurality of brace members 33 extending from front to back (as shown in FIGS. 2A and 2B), or alternatively extending laterally across shelves 30 (as shown in FIGS. 2C, 3A and 3B) to allow for different orientations of the bottles within the same shelf 30. In this embodiment, insert 32 may be constructed of wire, stainless steel, plastic or any other suitable material capable of supporting and maintaining the position of the bottles on shelves 30. Thus, insert 32 prevents the bottles from rolling and hitting into one another when shelves 30 are being opened and closed. Insert 32 may alternatively include arcuately shaped channels 35 configured to support the bottles within the arcuately shaped channels 35 to prevent them from rolling and hitting one another as shown in FIGS. 4A–5B. In this embodiment, insert 32 may be formed out of plastic, foam (such as STYROFOAM or a closed or open celled foam), or any other suitable material. Insert 32 in this embodiment may also be oriented either lengthwise (from front to back as shown in FIG. 5A) or laterally (side to side as shown in FIG. 4A) as with the first embodiment of insert 32 depending on the desired storage configuration. Also, insert 32 may include various sized channels 35 depending on how the user desires to store and orientate the bottles. In FIG. 4B, there are more channels 35 than in FIG. 5B, and the channels in FIG. 4B are also smaller in width. This allows the bottles to be staggered as shown.

Shelves 30 may also include a front lip 38 (FIGS. 1, 4A, and 5A) connected to front edge 42 (FIGS. 3A and 3B), to prevent the bottles from falling or rolling off shelves 30.

Alternatively, shelves 30 may include a plurality of retainer brackets 40 connected to front edge 42 of shelves 30 as shown in FIGS. 3A and 3B. Retainer brackets 40 prevent the bottles from falling or rolling off shelves 30 and allow visibility of bottle labels, unlike other storage systems. This unique configuration enables the user to identify and select a specific bottle/vintage without having to first remove it from the device to inspect the label. Such retainer brackets 40 may also be useful to include along a back edge of the shelves 30 to prevent the bottles from rolling off the back edge of the shelf 30.

Figure 6:
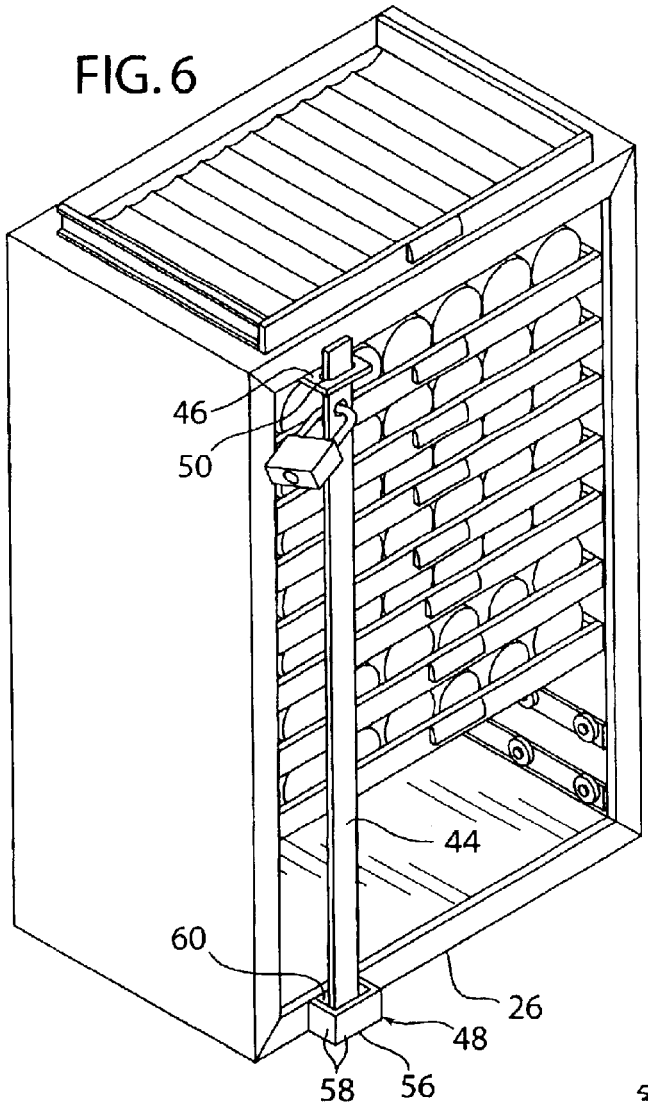
FIG. 6 is a perspective view of an embodiment of the storage unit of the present invention.
Figure 8:
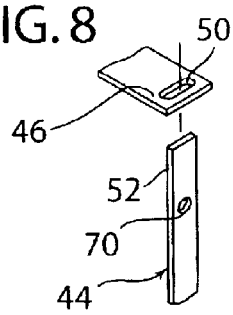
FIG. 8 is an exploded view illustrating a first bracket and strap connection of the present invention.
Figure 7:
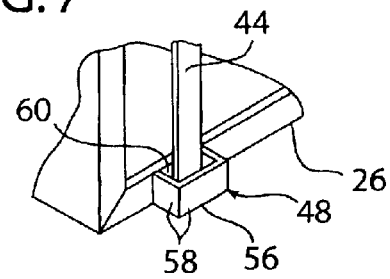
FIG. 7 is a perspective view illustrating a second bracket and strap connection of the present invention.

Another feature that may be added to storage unit 20 is a means to prevent movement of the shelves 30. A strap 44 is shown in FIG. 6 as an illustration of one such means that prevents shelves 30 from being opened. Other means to secure shelves 30 and items contained therein are known in the art, such as locking means found in filing cabinets. One such locking means is found in STEELCASE U.S. Pat. No. 5,823,643 incorporated herein by reference. In the example show in FIG. 6, strap 44 may be removably attached to frame member 22. As shown, frame member 22 may include a first bracket 46 extending outwardly from top 24 of frame member 22 and a second bracket 48 connected to base 26. First and second brackets 46 and 48 may be connected to frame member 22 in a variety of methods depending on the material used to construct frame member 22. For example, brackets 46 and 48 may be welded, threadably attached or nailed to frame member 22, or alternatively molded integrally with frame member 22. First bracket 46 includes a slot 50 configured to slidingly receive a first end 52 of strap 44. Second bracket 48 is configured to receive an opposite second end 54 of strap 44 and includes a bottom 56 (not visible) and side walls 58 defining an open-ended pocket 60 as shown in FIG. 7. In use, first end 52 of strap 44 may be inserted up through slot 50 as shown in FIG. 8. Strap 44 can then be lowered such that second end 54 is positioned within pocket 60 of second bracket 48. Strap 44 in its installed position extends substantially transverse across shelves 30 and prevents them from being opened.

Figure 9:
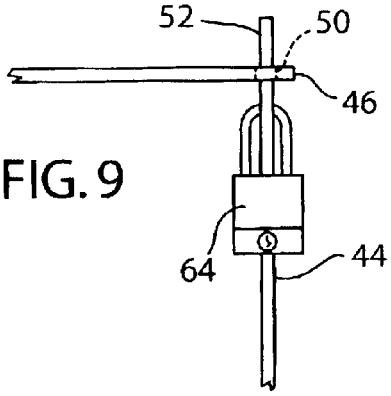
FIG. 9 is a side view illustrating a lock attached to the strap of the present invention.

To further secure storage unit 20 and prevent access to the items contained within shelves 30, an optional lock may be added. As shown in FIGS. 6, 8 and 9, first end 52 of strap 44 may include a hole 70 for which a standard lock apparatus 64 may be inserted and secured in a locked position. With lock apparatus 64 secured, strap 44 will be prevented from being removed. In a traditional prior art rack, as that shown in FIGS. 10A and 11A, a locking system such as strap 44 or those found in filing cabinets would not be effective in preventing access to the wine bottles since each bottle is contained within its own pocket or rack and there is no way to couple the pockets together to prevent access. Thus, a shelving storage system as in the present invention that is capable of being locked, provides yet a further advantage over the prior art.

Storage unit 20 may be constructed using a variety of different materials depending on where the unit will be stored and the specific aesthetic requirements of the user. In one embodiment, storage unit 20 may be constructed using traditional building and cabinetry material such as any variety of wood or wood laminated products. This embodiment would be appropriate for commercial uses such as within a retail store. In another embodiment, storage unit 20 may be constructed with specialized materials suited to a typical wine cellar environment. A typical wine cellar is maintained at a constant temperature of approximately 12 degrees Celsius and a constant humidity of approximately seventy percent. Traditional wood products that are susceptible to mold are often not well suited for a wine cellar environment because of the potential detrimental effects the mold can cause to the products that are stored therein. Therefore, certain wood products, such as Redwood and Cedar, that are naturally resistant to mold and better suited for a wine cellar environment.

While the invention has been described in conjunction with specific embodiments, it is evident that many alternatives, modifications and variations will be apparent to those skilled in the art in light of the foregoing description. Accordingly, the present invention attempts to embrace all such alternatives, modifications and variations that fall within the spirit and scope of the appended claims.

The invention claimed is:

1. A storage unit configured to store and display items, comprising:

a frame member including a plurality of vertically extending walls; a plurality of shelves slidably attached to said frame member and configured to store a plurality of items;

an insert positioned within at least one of said plurality of shelves; and wherein said insert supports and substantially minimizes movement of said stored items wherein said insert includes a plurality of arcuate channels and is made of foam.

2. The storage unit of claim 1 further comprising a locking mechanism.

3. The storage unit of claim 2 wherein said frame member further includes a top and a base, said top including a first bracket and said bottom including a second bracket and wherein the storage unit further comprises a strap having a first end and a second end and extending substantially transverse to a front edge of said plurality of shelves, said first end received within said first bracket and said second end received within said second bracket.

4. The storage unit of claim 3, further including a lock connected to said strap to prevent said strap from being removed.

5. The storage unit of claim 1, wherein said insert includes a plurality of brace members.

6. The storage unit of claim 1, wherein said slidable attachment includes roller bearings.

7. The storage unit of claim 1, wherein said plurality of shelves includes a front lip.

8. The storage unit of claim 1, wherein said plurality of shelves are removable from said frame member.

9. The storage unit of claim 1, wherein at least one of said plurality of shelves is removable from said frame creating a storage space for storing at least one object.

10. The storage unit of claim 9, wherein said removed at least one of said plurality of shelves is stored on a top surface of said frame member.

11. A storage unit configured to store and display items, comprising:

a frame member including a plurality of vertically extending walls; a plurality of shelves slidably attached to said frame member and configured to store a plurality of items;

an insert positioned within at least one of said plurality of shelves;

wherein said insert supports and substantially minimizes movement of said stored items; and wherein said plurality of shelves include a front edge and a plurality of curved retainer brackets extending substantially upward from said front edge.

12. A storage unit, comprising:

a frame member including a top, a base and a plurality of vertically extending walls;

a plurality of shelves slidably attached to said vertically extending walls having a front edge and a plurality of curved retainer brackets extending substantially upwardly from said front edge; and wherein said plurality of shelves is configured to store a plurality of items.

13. The storage unit of claim 12, wherein said frame member further includes a first bracket and a second bracket and a strap having a first end and a second end extending substantially transverse to said front edge, said first end received within said first bracket and said second end received within said second bracket; and wherein said strap prevents said plurality of shelves from sliding to an open position.

14. The storage unit of claim 12, wherein said plurality of shelves include a bottom surface and an insert positioned on said bottom surface, said insert configured to support and substantially minimize movement of said stored items.

15. The storage unit of claim 14, wherein said insert includes a plurality of brace members.

16. The storage unit of claim 14, wherein said insert includes a plurality of arcuate channels.

17. The storage unit of claim 12, wherein said slidable attachment includes roller bearings.

18. The storage unit of claim 12, wherein at least one of said plurality of shelves are removable from said frame member.

* * * * *